US006418887B1

(12) United States Patent
Okamoto

(10) Patent No.: US 6,418,887 B1
(45) Date of Patent: Jul. 16, 2002

(54) LUBRICANT COOLING SYSTEM FOR OUTBOARD MOTOR

(75) Inventor: Yutaka Okamoto, Shizuoka (JP)

(73) Assignee: Sanshin Kogyo Kabushiki Kaisha (JP)

( * ) Notice: Subject to any disclaimer, the term of this patent is extended or adjusted under 35 U.S.C. 154(b) by 0 days.

(21) Appl. No.: 09/417,642

(22) Filed: Oct. 14, 1999

(30) Foreign Application Priority Data

Oct. 14, 1998 (JP) ..... 10-292577

(51) Int. Cl.[7] ..... F01P 11/08
(52) U.S. Cl. ..... 123/41.33; 184/104.3
(58) Field of Search ..... 123/41.33, 196 AB, 123/196 W; 184/104.3

(56) References Cited

U.S. PATENT DOCUMENTS

| | | | | |
|---|---|---|---|---|
| 4,399,774 A | * | 8/1983 | Tsutsumi | 123/41.1 |
| 4,498,875 A | | 2/1985 | Watanabe | |
| 4,649,873 A | | 3/1987 | Amano | |
| 4,766,859 A | | 8/1988 | Miyaki et al. | |
| 4,790,273 A | | 12/1988 | Oguri et al. | |
| 4,953,525 A | | 9/1990 | Sakurai et al. | |
| 5,072,809 A | | 12/1991 | Shibata | |
| 5,215,044 A | * | 6/1993 | Banzhaf et al. | 123/41.29 |
| 5,439,404 A | | 8/1995 | Sumigawa | |
| 5,503,117 A | | 4/1996 | Saito | |
| 5,647,315 A | | 7/1997 | Saito | |
| 5,718,196 A | | 2/1998 | Uchiyama et al. | |
| 5,730,089 A | * | 3/1998 | Morikawa et al. | 123/41.14 |
| 5,733,157 A | | 3/1998 | Okuzawa | |
| 5,775,285 A | | 7/1998 | Takahashi | |
| 5,778,848 A | | 7/1998 | Takahashi et al. | |
| 5,809,963 A | | 9/1998 | Saito | |
| 5,876,256 A | | 3/1999 | Takahashi et al. | |
| 5,885,121 A | | 3/1999 | Nanami et al. | |
| 5,921,829 A | | 7/1999 | Iwata | |
| 5,951,343 A | | 9/1999 | Nanami et al. | |
| 5,980,340 A | | 11/1999 | Okamoto | |
| 6,015,320 A | | 1/2000 | Nanami | |
| 6,024,193 A | | 2/2000 | Fukushima | |
| 6,033,273 A | | 3/2000 | Nozue et al. | |
| 6,041,892 A | | 3/2000 | Watanabe et al. | |
| 6,059,619 A | | 5/2000 | Nozue | |
| 6,062,928 A | | 5/2000 | Watanabe et al. | |
| 6,067,951 A | | 5/2000 | Kitajima | |
| 6,076,495 A | | 6/2000 | Takahashi et al. | |
| 6,099,374 A | | 8/2000 | Watanabe et al. | |
| 6,109,219 A | | 8/2000 | Sano | |
| 6,182,631 B1 | | 2/2001 | Kitajima et al. | |

FOREIGN PATENT DOCUMENTS

JP 10-153120 6/1998

* cited by examiner

*Primary Examiner*—Tony M. Argenbright
*Assistant Examiner*—Katrina B. Harris
(74) *Attorney, Agent, or Firm*—Knobbe, Martens Olson & Bear, LLP

(57) ABSTRACT

An outboard motor contains a four-cycle engine. The engine includes a lubricant supply system that recirculates lubricant through the engine to lubricate the moving components of the internal combustion engine. The lubricant supply system includes a lubricant cooler. The lubricant cooler is selectively bypassed by lubricant and/or coolant to maintain the proper operating temperature range for the lubricant, depending upon the lubricant temperature and/or the coolant temperature.

62 Claims, 4 Drawing Sheets

LUBRICANT COOLING SYSTEM FOR OUTBOARD MOTOR

BACKGROUND OF THE INVENTION

1. Field of the Invention

The present invention generally relates to lubricant supply systems for four-cycle internal combustion engines used in powering watercraft. More particularly, the present invention relates to cooling systems for the lubricant supply systems of such engines.

2. Related Art

Watercraft are commonly powered by internal combustion engines contained within outboard motors. These motors have a water propulsion device, such as a propeller, which is driven by an output shaft of the internal combustion engine. The engine is also typically mounted within an enclosed cowling of the motor.

As is well known to those of ordinary skill in the art, internal combustion engines, particularly four-cycle internal combustion engines, require lubricant that is supplied to a crank chamber and other moving components of the engine by a lubricant pump. In general, the lubricant circulates between a crank chamber of the engines and a lubricant pan associated with the engines. These lubrication systems are arranged to provide lubricant from a supply to one or more galleries which, in turn, supply lubricant to bearings and other moving components of the internal combustion engines.

The lubricant being circulated within the engine is prone to great fluctuations in temperature. For instance, the crank chamber is exposed to substantial combustion heat (i.e., heat that results from the ignition of an air fuel charge within the combustion chamber). Thus, the temperature inside the crank chamber increases. Accordingly, the temperature of the lubricant passing through the crank chamber also rises. In some instances, the temperature of the lubricant may rise above 150° C. This elevated temperature creates problems, such as rapid degradation of lubricant quality and poor lubricant performance.

Preferably, the lubricant is maintained within an optimal operating temperature range. In some applications, the optimal operating temperature range is between about 60° C. to about 80° C. When the temperature of the lubricant is less than about 60° C., it becomes difficult to pump and flows less freely through the lubricating system and through the engine. On the other hand, when the temperature of the lubricant exceeds 80° C., the lubricant begins to thin and becomes less effective in forming a protective film over moving components of the engine.

Accordingly, some lubricant supply systems have been provided with lubricant cooling systems to prevent the lubricant from overheating. In some such lubricant cooling systems, heat exchangers are provided. The heat exchangers may use cooling water that is supplied from the body of water in which the watercraft is operating. Thus, the lubricant flowing through the heat exchangers may be cooled by the lower temperature cooling water flowing through the heat exchanger and back into the body of water in which the watercraft is operating. According to this arrangement, a fixed flow rate of coolant is provided to the heat exchanger.

The fixed flow rate has a tendency of overcooling the lubricant when the engine is operating at a low speed or when the engine temperature is low. Accordingly, the coolant flow rate through the heat exchanger may be fixed at a rate which does not overcool the lubricant (i.e., a low flow rate). However, this arrangement provides insufficient cooling to the lubricant when the engine temperature increases (i.e., during high speed operation). Moreover, especially for outboard motors, the coolant being drawn from a lake or ocean to be used as to the coolant, may have an exceedingly low temperature, thus even with a low flow rate, the lubricant may be cooled more than desired.

In an attempt to correct this overcooling, another type of lubricant cooling system has been developed. In this cooling system, a flow adjusting valve is provided within the coolant passage in which the coolant flow rate flowing to the heat exchanger is adjustable by opening and closing the valve, depending on the actual temperature of the lubricant. While providing a viable solution, this system is not without its disadvantages. For instance, fluctuations in the coolant flow rate may cause a negative load at the water pump. The negative load may deteriorate the operability of the water pump over time. Moreover, in watercraft being operated in saltwater environments, salt deposits may form on the adjusting valve, which salt deposits may eventually inhibit the long range usefulness of the lubricant cooling system.

SUMMARY OF THE INVENTION

Accordingly, an improved lubricant cooling system is desired. The system preferably reduces a fluctuation in lubricant temperature by increasing a heat transmission level between coolant and lubricant when the lubricant temperature is above a first predetermined temperature and reducing a heat transmission level between coolant and lubricant when the lubricant temperature is below a second predetermined temperature.

One aspect of the present invention involves a recirculating lubrication system comprising a lubricant supply and a lubricant supply passage extending from the supply to a crank chamber of an engine. A heat exchanger forms at least a portion of the lubricant supply passage with a bypass valve being interposed between the lubricant supply and the heat exchanger along the lubricant supply passage. A bypass conduit is connected to the bypass valve at a first end and the supply passage downstream of the heat exchanger at a second end. A temperature sensor is positioned along the supply passage with the temperature sensor being capable of detecting a temperature of the lubricant. The bypass valve is configured to alter a flow rate through at least one of the bypass conduit and the heat exchanger to regulate the temperature of the lubricant.

Another aspect of the present invention involves a four cycle outboard motor that comprises a lubrication system having a heat exchanger and a cooling system that delivers coolant to the heat exchanger. The lubrication system comprises a lubricant supply, a lubricant supply passage that extends from the lubricant supply to a crank chamber of the engine. The heat exchanger forms a portion of the lubricant supply passage. A lubricant temperature sensor is positioned along the lubricant supply passage and is capable of detects a temperature of lubricant passing through the lubricant supply passage. The cooling system comprises a coolant supply, a coolant supply passage that extends between the coolant supply and the heat exchanger and a coolant supply bypass valve that is positioned along the coolant supply passage between the coolant supply and the heat exchanger. A coolant supply bypass conduit communicates with the coolant supply passage through the coolant supply bypass valve. The coolant supply bypass valve is capable of selectively diverting at least a portion of the coolant delivered through the coolant supply passage away from the heat exchanger through the coolant bypass conduit.

BRIEF DESCRIPTION OF THE DRAWINGS

These and other features, aspects and advantages of the present invention will now be described with reference to the drawings of certain preferred embodiments, which embodiments are intended to illustrate and not to limit the invention, and which include the following figures.

DETAILED DESCRIPTION OF THE PREFERRED EMBODIMENTS OF THE INVENTION

Figure 1:
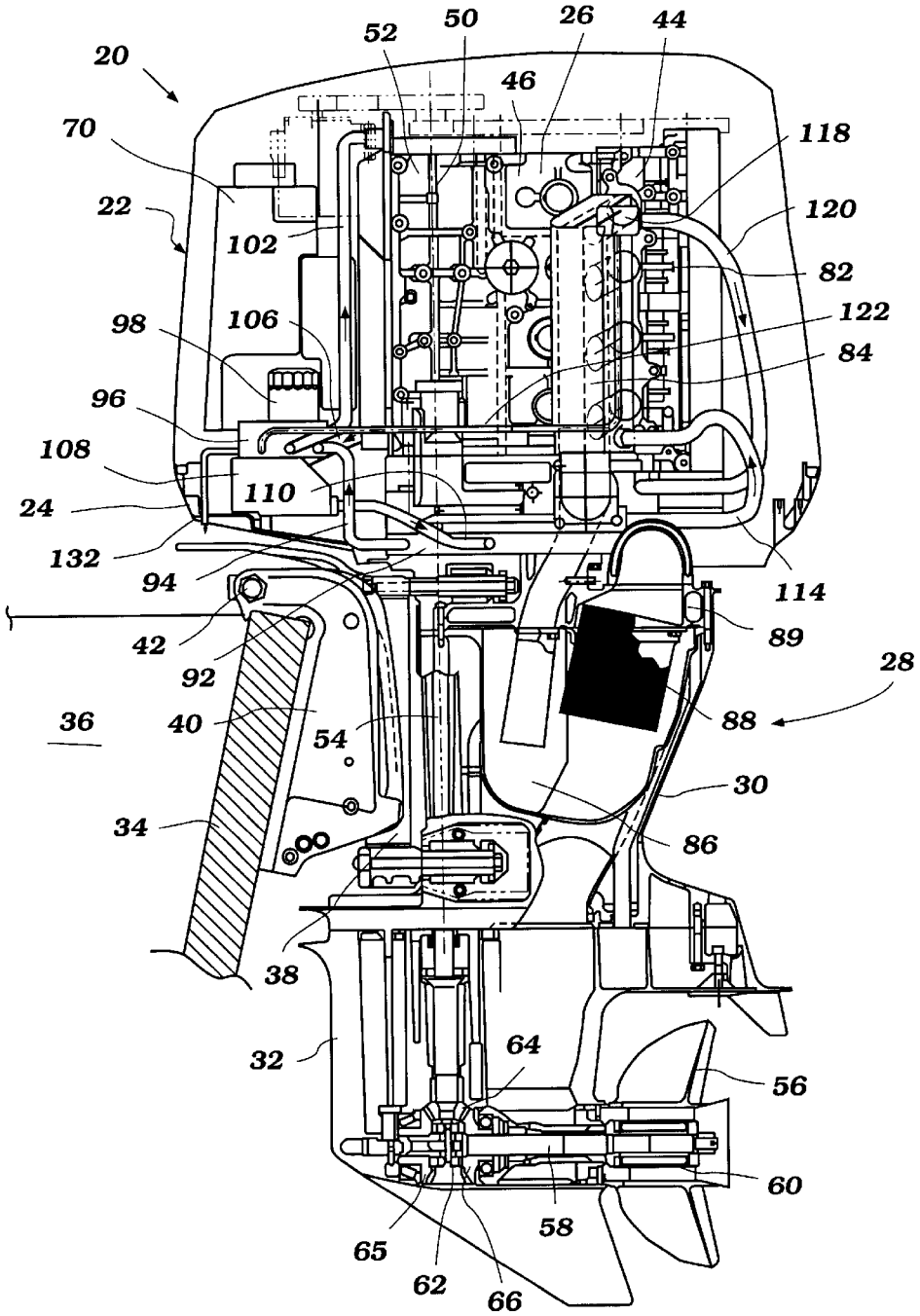
FIG. 1 is a cross-sectional side view of an outboard motor powered by an internal combustion engine and having a lubricant cooling system arranged and configured in accordance with certain features, aspects and advantages of the present invention.

With initial reference to FIG. 1, an outboard motor, indicated generally by the reference numeral 20, having a lubricant cooling system is illustrated therein. The lubricant cooling system is preferably used to cool lubricant of a lubrication system of an internal combustion engine powering the outboard motor. The lubricant cooling system of the present invention will be described in conjunction with a lubrication system of an internal combustion engine of an outboard motor because this is an application for which the present system has particular utility. However, those of ordinary skill in the art will readily appreciate that the system may also have utility in a variety of other applications (i.e., with an inboard marine engine, automobile engine or snowmobile engine).

With continued reference to FIG. 1, the outboard motor 20 preferably includes a power head which generally comprises a main cowling 22 and a tray 24. The tray 24 supports the main cowling 22 in any suitable manner. The engine 26 is positioned within the cowling 22 such that the power head forms a protective enclosure for the engine 26.

The outboard motor 20 also includes a lower portion 28 that extends below the power head. The lower portion 28 preferably includes a drive shaft housing portion 30 and a lower unit 32. As will be described below, the drive shaft housing portion 30 is an elongate section extending in a generally vertical direction. The lower unit 32 depends from the drive shaft housing 30 and includes at least a portion of a transmission.

The outboard motor 20 is preferably connected to a hull 34 of a watercraft 36. Preferably, the outboard motor is attached to a transom portion of the watercraft 36, which is formed at a stern of the watercraft 36. A swivel bracket 38 is connected to the motor and includes a generally vertically-extending swivel shaft. The motor 20 can be moved about the swivel shaft of the swivel bracket 38 to move the motor from side to side about the swivel shaft. Thus, the motor may be steered through movement about the swivel shaft. In some motors, a steering handle (not shown) may be connected to the motor 20 to enable an operator to control steering movement of the motor.

A clamping bracket 40 attaches the swivel bracket 38 to the hull 34 of the watercraft 36. The clamping bracket preferably includes a pivot pin 42. The pivot pin 42 preferably defines a trim axis that extends in a generally horizontal direction. The illustrated motor 20 is advantageously capable of pivoting about the trim axis defined by the pivot pin 42. Thus, the motor 20 may be raised up and down or "trimmed" to achieve a desired direction of thrust.

The engine 26 is preferably of the four-cylinder variety, arranged in in-line fashion, and operating on a four-cycle principle. As may be appreciated by those of ordinary skill in the art, the engine 26 may have a greater number of cylinders or a lesser number of cylinders, may be arranged in other than in-line fashion, and may operate on other operating principles, such as a rotary principle.

Figure 3:
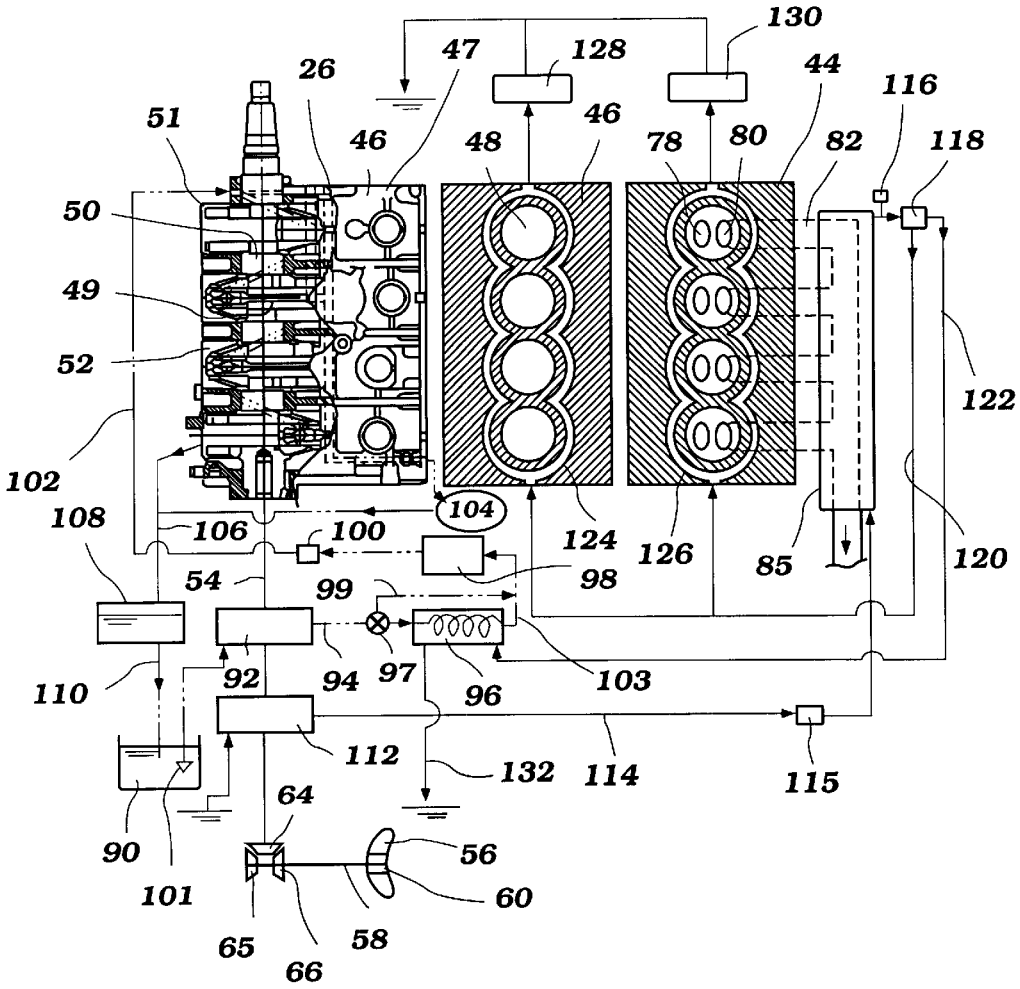
FIG. 3 is a schematic of the lubricant cooling system, having features, aspects and advantages in accordance with the present invention, with related portions of the engine and motor illustrated therein.

The engine 26 preferably generally comprises a cylinder head 44 that is connected to a cylinder block 46. With reference to FIG. 3, the illustrated cylinder block 46 includes four cylinders 48. As is well known to those of ordinary skill in the art, a piston 47 is movably mounted in each cylinder 48. The piston 47, in cooperation with the cylinder block 46 and the head 44, at least partially defines a variable volume combustion chamber. Each piston 47 is connected via a connecting rod 49 to a generally vertically-extending crankshaft 50. Thus, translating movement of the pistons 47 is transformed into rotational movement of the crankshaft 50.

The crankshaft 50 preferably is positioned in a crank case chamber 52. In the illustrated engine 26, the crankcase chamber 52 is defined by a crankcase cover 51 that is connected to the cylinder block 46. As illustrated, the crankcase cover 51 is preferably positioned at the opposite end of the cylinder block 46 from the cylinder head 44.

The crankshaft 50 extends below the engine 26 and is connected to a drive shaft 54 in any suitable manner. The drive shaft 54 extends through the lower portion 28 of the motor 20 and is arranged to drive a water propulsion device of the motor 20. As illustrated, the water propulsion device in the illustrated embodiment is a propeller 56. Of course, other water propulsion devices, such as jet pumps, for instance, may also be used. Preferably, a propeller shaft 58 is connected to a hub 60 of the propeller 56. The illustrated drive shaft 54 drives the propeller shaft 58 through a conventional forward neutral reverse transmission 62 as known to those of ordinary skill in the art. As illustrated, the transmission 62 includes a bevel gear 64 mounted on the drive shaft 54 that selectively engages forward and reverse bevel gears 65, 66, which are mounted on the propeller shaft 58. A shift mechanism (not shown) is preferably provided for permitting an operator of the watercraft 36 to move the transmission into the forward, neutral or reverse positions.

Figure 2:
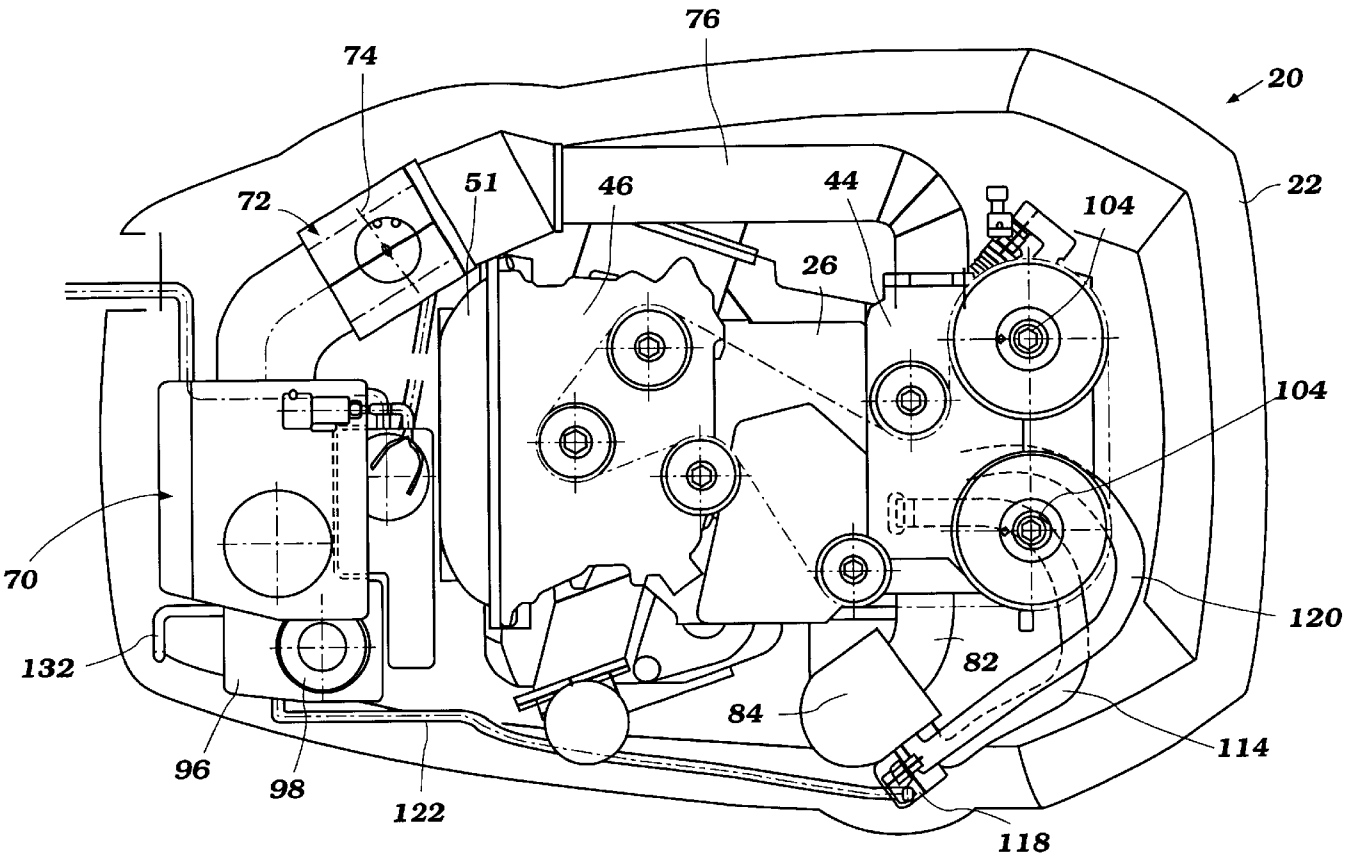
FIG. 2 is a cross-sectional top view of the motor illustrated in FIG. 1.

With reference to FIGS. 1 and 2, an intake system provides air to each cylinder 48. Preferably, air is drawn from within the cowling 22 of the motor 20 through an intake of a surge tank 70. With reference to FIG. 2, the air then flows to a throttle body 72 in the illustrated motor. A throttle valve 74 is desirably positioned within the throttle body 72. The throttle valve 74 controls the flow of air to the engine 26. The air that passes the valve 74 flows through an intake runner 76 to an intake passage (not shown) that leads through the cylinder head 44 to an intake port 78 leading into each cylinder 48 (see FIG. 3). Preferably, the runner 76 corresponds to a single cylinder 48 and provides air to a passage leading into the cylinder 48.

A suitable fuel supply system preferably supplies fuel to each cylinder 48. An ignition system is also preferably provided that ignites the fuel and air in the combustion chamber. Such systems are well known to those of ordinary skill in the art.

An exhaust system is provided that routes the products of combustion from each cylinder 48 to the outside atmosphere. With reference to FIGS. 2 and 3, exhaust preferably flows through an exhaust port 80 leading from the cylinder 48 through the cylinder head 44 to an exhaust header 82 of an exhaust manifold 84 (shown in FIG. 2). Preferably, the exhaust system defines an exhaust path leading from the manifold 84 in an expansion chamber 86 (shown in FIG. 1) positioned in the lower portion 28 and having a catalyst 88 positioned therein. The exhaust system then extends from the expansion chamber 86 to an exhaust discharge 89. The exhaust gases may also be discharged from the lower unit 32 (i.e., through the propeller 56).

In accordance with certain features, aspects and advantages of the present invention, the engine 26 also includes a lubricating system which provides lubricant to one or more portions of the engine. As used herein, the term "lubricant" is synonymous with oil and it means materials used to lubricate moving components of an engine, such as natural petroleum, oil, or synthetic oils or the like. As described in more detail below, a lubricant cooling system is also provided for cooling the lubricant of the lubricating system. In accordance with certain aspects, features and advantages of the present invention, the rate of cooling of the lubricant is increased as the temperature of the coolant increases, and decreased as the temperature of the coolant decreases.

With reference to FIG. 3, the lubricating system includes a lubricant supply 90, such as a lubricant tank, which may be positioned within the hull 34 of the watercraft 36, or a lubricant pan, which may be positioned within the motor. Lubricant is drawn from the supply 90 and delivered to the engine 26 in the illustrated system. Preferably, the lubricant is drawn from the supply 90 and delivered to the engine 26 through the use of a lubricant pump 92. The pump 92 draws the lubricant from the supply 90 and delivers it through a supply line 94 to a lubricant filter 98, a lubricant temperature sensor 100, and thereon through a lubricant line 102 to one or more lubricant galleries positioned throughout the engine 26. Of course, various components may be positioned in other locations along the lubricant supply system. For instance, the temperature sensor 100 may be positioned along a return line that returns lubricant to the supply. With reference to FIG. 3, the lubricant pump 92 is preferably driven by the drive shaft 54 and arranged to draw lubricant through a coarsely screened inlet 101. Of course, the pump 92 may be driven by the crank shaft 50 in some motors. The coarsely screened inlet 101 may be any suitable type of screened inlet. Preferably, the screen removes a large percentage small particles that may damage engine components or lubricant system passages if passed through the lubricant system.

Preferably, at least a portion of the lubricant passes through a heat exchanger 96 positioned along the supply line 94. In the illustrated system, the heat exchanger 96 is positioned between the pump 92 and the lubricant filter 98. Within the heat exchanger 96, heat is transferred from the lubricant to coolant that is circulated through the heat exchanger, as will be described in more detail below.

Advantageously, a bypass valve 97 is positioned along the supply line 94 upstream of the heat exchanger 96, such that a portion of the lubricant can be bypassed by the valve 97 through a bypass line 99 directly into the filter 98 without having first passing through the lubricant cooler 96 and a direct line 103.

The lubricant passes through the engine 26 and preferably lubricates at least one camshaft 104. Although not described above, the camshaft 104 is preferably provided for actuating a valve which controls the flow of air through each intake port 78 and a valve for controlling the flow of exhaust through each exhaust port 80, as is well known to those of ordinary skill in the art. Of course, more than one camshaft 104 may also be used. The lubricant preferably drains through one or more return passages or pipes 106 to a subtank 108 and then through a pipe 110 back to the supply 90. As will be apparent to those of ordinary skill in the art, the subtank may be eliminated in some systems.

In accordance with the present invention, a cooling system is provided for cooling various parts of the engine 26. As best illustrated in FIG. 3, the coolant preferably comprises water drawn from the body of water in which the watercraft 36 is operated. The coolant may comprise a man-made coolant or a mixture of man-made coolant and water in some arrangements, in which arrangements the coolant system preferably forms a closed loop.

With reference to FIG. 3, water is drawn from the body of water through an inlet formed in the motor 20 and delivered to the engine 26. Preferably, the water is drawn from the body of water by a coolant pump 112 in the illustrated motor 20. As illustrated in FIG. 3, the coolant pump 112 is desirably driven by the drive shaft 54 through the output shaft 50 of the engine 26. Thus, the pump 112 is preferably positioned in the lower portion 28 of the motor 20 and driven by the drive shaft 54. The pump 112 delivers coolant through a delivery line 114 to a cooling jacket 84 of the exhaust manifold 82. As is known, the cooling jacket substantially encases at least a portion of the exhaust system and cools the exhaust gases and exhaust system components. Preferably, a coolant pressure sensor 115 is positioned along the delivery line 114 for sensing the pressure of the coolant within the coolant system. The pressure sensor 115 may be used to detect whether the cooling system is functioning properly.

The coolant then flows through a temperature sensor 116 to a pressure control valve 118. The valve 118 is arranged to deliver coolant at a regulated pressure to a first coolant line 120 leading to the engine 26 and/or a second coolant line 122 leading to the lubricant cooler 96.

The coolant supplied to the first line 120 flows to various cooling jackets 124, 126 that cool at least portions of the cylinder block 46 and the cylinder head 44. After flowing through these cooling jackets 124, 126, the coolant selectively flows through at least one of a set of thermostats 128, 130 to a coolant discharge associated with that thermostat. The discharge may pass through the motor 20 back to the body of water in which the motor 20 is being operated. The thermostats 128, 130 are preferably arranged so that when the coolant, and thus the engine, temperature is too low, the flow of the coolant through the cooling jackets 124, 126 of the engine is slowed or stopped to allow the engine 26 to heat up. When the engine 26, and thus the coolant, is warm, the thermostats 128, 130 open to permit coolant to flow through the coolant jackets 124, 126 to the discharge.

The coolant delivered to the second line 122 flows to the heat exchanger 96 where the coolant cools the lubricant. The coolant then flows through a discharge 132 to a point external to the motor 20. In some embodiments, the coolant is emptied into the body of water in which the watercraft is being operated. In other arrangements, the coolant can be circulated through other cooling jackets before being discharged into the body of water in which the watercraft is being operated.

In the illustrated embodiment, the valve 97 is used to control the flow rate of lubricant through the heat exchanger 96 such that the lubricant is cooled very little if the lubricant temperature is low and the amount of lubricant flowing through the heat exchanger 96 is increased as the temperature of the lubricant increases. Thus, lubricant is bypassed through the bypass line 99 around the heat exchanger 96 and mixed with lubricant that flows through the heat exchanger 96 to establish a predetermined temperature. Thus, in accordance with the present invention, when the lubricant temperature is low, the lubricant is either not cooled or cooled very little. In this manner, the lubricant temperature is not cooled below the preferred low operating temperature level. Once the lubricant temperature rises, the lubricant flow rate through the heat exchanger 96 is increased to keep the operating temperature of the lubricant within the desired high temperature limit.

While in some applications, the valve 97 may be a thermostat-type of valve, the valve 97 is preferably controlled by an actuator or other mechanism through a control unit (not shown). The control unit receives an output signal from the temperature sensor 100 and opens or closes the valve such that the temperature of the lubricant may be properly regulated. In some applications, a further output signal may be received from the cooled temperature sensor 116 such that the positioning of the valve 97 may accommodate the temperature of the coolant being directed through the heat exchanger 96. As will be readily apparent to those of ordinary skill in the art, the valve 97 and the associated bypass conduit may be located in other positions along the lubricant flow path. For instance, the valve and the conduit may be located along a lubricant return passage through which lubricant is returned from the engine to the supply.

Figure 4:
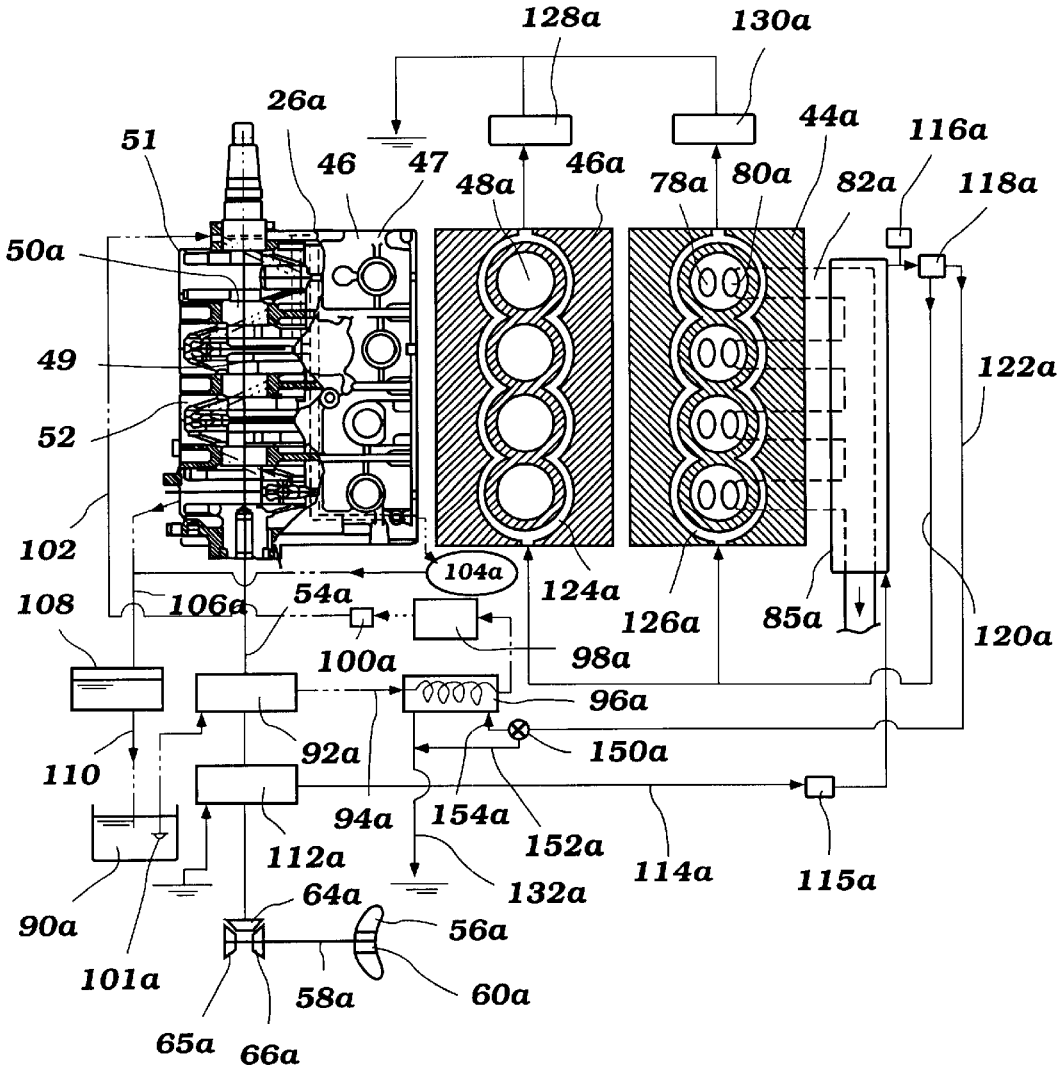
FIG. 4 is a schematic of another lubricant cooling system arranged and configured in accordance with certain features, aspects and advantages of the present invention with related portions of the engine and motor illustrated.

With reference now to FIG. 4, another lubricant cooling system having certain features, aspects and advantages of the present invention is illustrated therein. This lubricant cooling system is similar to the first described lubricant cooling system which is illustrated in FIGS. 1–3. As such, like or similar parts have been given like reference numerals to those used in the description of FIGS. 1–3, except that an "a" designator has been added to all the reference numerals in this embodiment. Also, the above description applies to these like components unless otherwise noted.

With reference to FIGS. 3 and 4, the bypass route 99 of FIG. 3 has been removed from the lubricant system illustrated in FIG. 4. Thus, all the lubricant flows through the heat exchanger 96*a* of the illustrated motor. The temperature of the lubricant flowing through the heat exchanger 96*a* is therefore controlled by the flow rate of coolant being passed through the heat exchanger 96*a*. As illustrated, a coolant control valve 150*a* is positioned along the coolant supply line 122*a* upstream of the heat exchanger 96*a*. This valve 150*a* bypasses a portion of coolant through a bypass line 152*a* into the discharge line 132*a*. By bypassing a portion of the coolant through the bypass line 152*a* rather than the coolant delivery line 154*a*, the degree of heat transfer taking place within the heat exchanger 96*a* may be reduced.

With continued reference to FIG. 4, the coolant pump 112*a*, which is driven by the crankshaft 50*a* of the engine 26*a* (i.e., through the drive shaft 54*a*) increases the flow of coolant as the speed of the engine increases. Thus, the coolant pressure in the delivery line 114*a* is increased as the engine speed increases. Accordingly, as the coolant pressure of the delivery line 114*a* increases, the pressure control valve 118*a* is arranged to regulate the coolant pressure in the line 122*a* leading to the lubricant cooler 96*a*. In this manner, as the engine speed increases and the lubricant temperature correspondingly increases, the flow rate of the coolant to the cooler 96*a* is substantially maintained.

On the other hand, a temperature sensor 116*a* determines the temperature of the coolant being supplied through the line 122*a* to the heat exchanger 96*a*. The bypass valve 150 is operated to control the degree of heat transfer that may occur within the heat transfer component 96*a*. In this manner, when the engine is operating at a low speed and the lubricant is cooler, the cooling rate may be maintained low as well, allowing the lubricant to be maintained above the lowest desirable operating temperature. Accordingly, the rate of lubricant cooling is adjusted based both upon the temperature of the lubricant as measured directly or indirectly so that the lubricant is maintained in the desired operating range. Additionally, the rate of lubricant cooling is also adjusted based upon the temperature of the coolant being supplied to the heat exchanger 96*a*. Accordingly, the degree of lubricant cooling may be adjusted to a proper level depending on the operating parameters of the engine, as well as the temperature of the coolant being supplied to the heat exchanger 96*a*.

Although the present invention has been described in terms of a certain embodiment, other embodiments apparent to those of ordinary skill in the art also are within the scope of this invention. Thus, various changes and modifications may be made without departing from the spirit and scope of the invention. In addition, various aspects, features and advantages from the illustrated systems may be interchanged or combined in various applications. For instance, in some applications, a lubricant bypass as illustrated in FIG. 3 may be used in conjunction with a coolant bypass as illustrated in FIG. 4. Moreover, not all of the features, aspects and advantages are necessarily required to practice the present invention. Accordingly, the scope of the present invention is intended to be defined only by the claims that follow.

What is claimed is:

1. A recirculating lubrication system comprising a dry sump lubricant supply, a lubricant supply passage extending from said supply to a crank chamber of an engine, a heat exchanger forming at least a portion of said lubricant supply passage, a bypass valve interposed between said lubricant supply and said heat exchanger along said lubricant supply passage, a bypass conduit connected to said bypass valve at a first end and said supply passage downstream of said heat exchanger at a second end, a temperature sensor positioned along said supply passage, said temperature sensor being capable of detecting a temperature of the lubricant, said bypass valve being configured to alter a flow rate through at least one of said bypass conduit and said heat exchanger.

2. The system of claim 1, wherein said bypass valve increases the flow rate through said bypass conduit when the temperature of the lubricant is below a predetermined temperature.

3. The system of claim 1, wherein said bypass valve increases the flow rate through said heat exchanger when the temperature of the lubricant is above a predetermined temperature.

4. The system of claim 1 further comprising a lubricant filter positioned along said supply passage downstream of a junction between said supply passage and said second end of said bypass conduit.

5. The system of claim 4, wherein said lubricant filter is positioned upstream of said temperature sensor.

6. The system of claim 1, wherein said lubricant supply comprises a lubricant pan positioned within an outboard motor.

7. The system of claim 1, wherein said temperature sensor is interposed along said supply passage between said heat exchanger and the crank chamber of the engine.

8. The system of claim 1, wherein said heat exchanger forms a portion of an open loop engine cooling system.

9. The system of claim 8, wherein said heat exchanger is provided with coolant that has previously flowed through at least a portion of an exhaust system cooling jacket.

10. The system of claim 9 further comprising a lubricant pump, said lubricant pump circulating lubricant through the lubrication system from said lubricant supply and being powered by an output shaft from the engine.

11. A four cycle outboard motor comprising a lubrication system having a heat exchanger and a cooling system that delivers coolant to said heat exchanger, said lubrication system comprising a lubricant supply, a lubricant supply passage extending from said lubricant supply to a crank chamber of said engine with said heat exchanger forming a portion of said lubricant supply passage, and a lubricant temperature sensor being positioned along said lubricant supply passage and being capable of detecting a temperature of lubricant passing through said lubricant supply passage, said cooling system comprising a coolant supply, a coolant supply passage extending between said coolant supply and said heat exchanger, a coolant supply bypass valve positioned along said coolant supply passage between said coolant supply and said heat exchanger, a coolant supply bypass conduit communicating with said coolant supply passage through said coolant supply bypass valve, and said coolant supply bypass valve being capable of selectively diverting at least a portion of the coolant being delivered through said coolant supply passage away from said heat exchanger through said coolant bypass conduit.

12. The motor of claim 11, wherein said coolant bypass valve is operated to decrease a flow of coolant to said heat exchanger when said lubricant temperature sensor detects a lubricant temperature below a predetermined temperature.

13. The motor of claim 11, wherein said coolant bypass valve is operated to increase a flow of coolant to said heat exchanger when said lubricant temperature sensor detects a lubricant temperature above a predetermined temperature.

14. The motor of claim 11, wherein said coolant bypass valve is operated to decrease a flow of coolant to said heat exchanger when said coolant supply bypass conduit directly communicates with a coolant discharge conduit.

15. The motor of claim 11 further comprising a coolant temperature sensor being positioned along said coolant supply passage between said coolant supply and said coolant supply bypass valve and being capable of detecting a coolant temperature, said coolant supply bypass valve being selectively controlled based at least in part upon a detected temperature of said coolant.

16. The motor of claim 15, wherein said coolant passage includes at least a portion of an exhaust system cooling jacket with said coolant temperature sensor being located downstream from said exhaust system cooling jacket.

17. The motor of claim 11 further comprising a coolant pump being capable of circulating coolant through said coolant supply passage and being powered by an output shaft of said motor.

18. An outboard motor comprising a lubrication system and a cooling system, said lubrication system and said cooling system interacting with one another at a heat exchanger, said heat exchanger cooling lubricant being transported by said lubrication system with coolant being transported by said cooling system, said motor further comprising means for controlling a degree of heat transfer between said lubrication system and said cooling system, said means decreasing said degree of heat transfer when said lubricant is below a first predetermined temperature and said means increasing said degree of heat transfer when said lubricant is above a second predetermined temperature.

19. The motor of claim 18, wherein said first predetermined temperature is approximately 60 degrees Celsius.

20. The motor of claim 18, wherein said second predetermined temperature is approximately 80 degrees Celsius.

21. The motor of claim 18 further comprising a coolant temperature sensor, said degree of heat transfer being at least partially dependent on a temperature of the coolant being introduced into said heat exchanger.

22. The motor of claim 18, wherein the means for controlling a degree of heat transfer is positioned within the lubrication system between a lubricant supply and the engine.

23. The motor of claim 18, wherein the means for controlling a degree of heat transfer is positioned within the cooling system.

24. The motor of claim 18, wherein said means for controlling a degree of heat transfer comprises a flow bypass control valve.

25. The motor of claim 24, wherein said flow bypass control valve is a coolant supply bypass valve.

26. The motor of claim 25, wherein said coolant supply bypass valve is positioned along a coolant passage between a coolant supply and said heat exchanger.

27. The motor of claim 24, wherein said flow bypass control valve is a bypass valve positioned along a lubricant supply passage.

28. The motor of claim 27, wherein said bypass valve is positioned along said lubricant supply passage between a lubricant supply and said heat exchanger.

29. The motor of claim 18, wherein said means for controlling a degree of heat transfer comprises a temperature sensor and a valve and output from said temperature sensor is used to control said valve.

30. The motor of claim 18, wherein said means for controlling a degree of heat transfer comprises a thermostat-type valve.

31. The motor of claim 18, wherein said means for controlling a degree of heat transfer comprises an actuator-control valve.

32. An outboard motor comprising a recirculating lubrication system having a heat exchanger and a cooling system that delivers coolant to said heat exchanger, said recirculating lubrication system comprising a lubricant supply, a lubricant supply passage extending from said lubricant supply to a crank chamber of an engine, said heat exchanger forming at least a portion of said lubricant supply passage, a lubricant bypass valve interposed between said lubricant supply and said heat exchanger along said lubricant supply passage, a lubricant bypass conduit connected to said lubricant bypass valve at a first end and said lubricant supply passage downstream of said heat exchanger at a second end, a lubricant temperature sensor positioned along said lubricant supply passage, said lubricant temperature sensor being capable of detecting a temperature of the lubricant, said lubricant bypass valve being configured to alter a flow rate through at least one of said lubricant bypass conduit and said heat exchanger, said cooling system comprising a coolant supply, a coolant supply passage extending between said coolant supply and said heat exchanger, a coolant supply bypass valve positioned along said coolant supply passage between said coolant supply and said heat exchanger, a coolant supply bypass conduit communicating with said coolant supply passage through said coolant supply bypass valve, and said coolant supply bypass valve being capable of selectively diverting at least a portion of the coolant being delivered through said coolant supply passage away from said heat exchanger through said coolant bypass conduit.

33. The motor of claim 32, wherein said coolant bypass valve is operated to decrease a flow of coolant to said heat exchanger when said lubricant temperature sensor detects a lubricant temperature below a predetermined temperature.

34. The motor of claim 32, wherein said coolant bypass valve is operated to increase a flow of coolant to said heat exchanger when said lubricant temperature sensor detects a lubricant temperature above a predetermined temperature.

35. The motor of claim 32, wherein said coolant bypass valve is operated to decrease a flow of coolant to said heat exchanger when said coolant supply bypass conduit directly communicates with a coolant discharge conduit.

36. The motor of claim 32 further comprising a coolant temperature sensor being positioned along said coolant supply passage between said coolant supply and said coolant supply bypass valve and being capable of detecting a coolant temperature, said coolant supply bypass valve being selectively controlled based at least in part upon a detected temperature of said coolant.

37. The motor of claim 36, wherein said coolant passage includes at least a portion of an exhaust system cooling jacket with said coolant temperature sensor being located downstream from said exhaust system cooling jacket.

38. The motor of claim 32 further comprising a coolant pump being capable of circulating coolant through said coolant supply passage and being powered by an output shaft of said motor.

39. The system of claim 32, wherein said lubricant bypass valve increases the flow rate through said lubricant bypass conduit when the temperature of the lubricant is below a predetermined temperature.

40. The system of claim 32, wherein said lubricant bypass valve increases the flow rate through said heat exchanger when the temperature of the lubricant is above a predetermined temperature.

41. The system of claim 32 further comprising a lubricant filter positioned along said lubricant supply passage downstream of a junction between said lubricant supply passage and said second end of said lubricant bypass conduit.

42. The system of claim 41, wherein said lubricant filter is positioned upstream of said lubricant temperature sensor.

43. The system of claim 32, wherein said lubricant supply comprises a lubricant pan.

44. The system of claim 32, wherein said lubricant temperature sensor is interposed along said lubricant supply passage between said heat exchanger and the crank chamber of the engine.

45. The system of claim 32, wherein said heat exchanger forms a portion of an open loop engine cooling system.

46. The system of claim 45, wherein said heat exchanger is provided with coolant that has previously flowed through at least a portion of an exhaust system cooling jacket.

47. The system of claim 46 further comprising a lubricant pump, said lubricant pump circulating lubricant through the lubrication system from said lubricant supply and being powered by an output shaft from the engine.

48. A recirculating lubrication system comprising a lubricant supply, a lubricant supply passage extending from said supply to a crank chamber of an engine, a heat exchanger forming at least a portion of said lubricant supply passage, said heat exchanger being in communication with coolant passing through at least a portion of a cooling system of said engine, a bypass valve interposed between said lubricant supply and said heat exchanger along said lubricant supply passage, a bypass conduit connected to said bypass valve at a first end and said supply passage downstream of said heat exchanger at a second end, a temperature sensor positioned along said supply passage, said temperature sensor being capable of detecting a temperature of the lubricant, said bypass valve being configured to alter a flow rate through at least one of said bypass conduit and said heat exchanger.

49. The system of claim 48, wherein said bypass valve increases the flow rate through said bypass conduit when the temperature of the lubricant is below a predetermined temperature.

50. The system of claim 48, wherein said bypass valve increases the flow rate through said heat exchanger when the temperature of the lubricant is above a predetermined temperature.

51. The system of claim 48 further comprising a lubricant filter positioned along said supply passage downstream of a junction between said supply passage and said second end of said bypass conduit.

52. The system of claim 51, wherein said lubricant filter is positioned upstream of said temperature sensor.

53. The system of claim 48, wherein said lubricant supply comprises a lubricant pan positioned within an outboard motor.

54. The system of claim 48, wherein said temperature sensor is interposed along said supply passage between said heat exchanger and the crank chamber of the engine.

55. The system of claim 48, wherein said cooling system of said engine is an open loop engine cooling system.

56. The system of claim 55, wherein said heat exchanger is provided with coolant that has previously flowed through at least a portion of an exhaust system cooling jacket.

57. The system of claim 56 further comprising a lubricant pump, said lubricant pump circulating lubricant through the lubrication system from said lubricant supply and being powered by an output shaft from the engine.

58. A recirculating lubrication system comprising a lubricant supply, a lubricant supply passage extending from said supply to a crank chamber of an engine, a heat exchanger forming at least a portion of said lubricant supply passage, a bypass valve interposed between said lubricant supply and said heat exchanger along said lubricant supply passage, a bypass conduit connected to said bypass valve at a first end and said supply passage downstream of said heat exchanger at a second end, a lubricant filter positioned along said supply passage downstream of a junction between said supply passage and said second end of said bypass conduit, a temperature sensor positioned along said supply passage, said temperature sensor being capable of detecting a temperature of the lubricant, said bypass valve being configured to alter a flow rate through at least one of said bypass conduit and said heat exchanger.

59. The system of claim 58, wherein said lubricant filter is positioned upstream of said temperature sensor.

60. A recirculating lubrication system comprising a lubricant pan positioned within an outboard motor, a lubricant supply passage extending from said pan to a crank chamber of an engine, a heat exchanger forming at least a portion of said lubricant supply passage, a bypass valve interposed between said lubricant pan and said heat exchanger along said lubricant supply passage, a bypass conduit connected to said bypass valve at a first end and said supply passage downstream of said heat exchanger at a second end, a temperature sensor positioned along said supply passage, said temperature sensor being capable of detecting a temperature of the lubricant, said bypass valve being configured to alter a flow rate through at least one of said bypass conduit and said heat exchanger.

61. A recirculating lubrication system comprising a lubricant supply, a lubricant supply passage extending from said supply to a crank chamber of an engine, a heat exchanger forming at least a portion of said lubricant supply passage and forming a portion of an open loop engine cooling system, said heat exchanger being provided with coolant that has previously flowed through at least a portion of an exhaust system cooling jacket, a bypass valve interposed between said lubricant supply and said heat exchanger along said lubricant supply passage, a bypass conduit connected to said bypass valve at a first end and said supply passage downstream of said heat exchanger at a second end, a temperature sensor positioned along said supply passage, said temperature sensor being capable of detecting a temperature of the lubricant, said bypass valve being configured to alter a flow rate through at least one of said bypass conduit and said heat exchanger.

62. The system of claim 61 further comprising a lubricant pump, said lubricant pump circulating lubricant through the lubrication system from said lubricant supply and being powered by an output shaft from the engine.

* * * * *